United States Patent [19]

Gutowski

[11] Patent Number: 4,530,688

[45] Date of Patent: Jul. 23, 1985

[54] FILE FOLDER UNFOLDING MACHINE

[76] Inventor: Richard W. Gutowski, 110 Pecan Grove Dr., Hattiesburg, Miss. 39401

[21] Appl. No.: 503,805

[22] Filed: Jun. 13, 1983

[51] Int. Cl.[3] ..... B31B 1/26

[52] U.S. Cl. ..... 493/409; 290/55

[58] Field of Search ..... 493/409, 949; 270/55, 270/57

[56] References Cited

U.S. PATENT DOCUMENTS 3,152,800 10/1964 Hanson ..... 493/409

3,938,799 2/1976 Macke ..... 270/55

FOREIGN PATENT DOCUMENTS 895720 1/1982 U.S.S.R. ..... 493/409

*Primary Examiner*—Leonidas Vlachos

*Attorney, Agent, or Firm*—James E. Nilles; James R. Custin

[57] ABSTRACT

The machine for unfolding folded file folders has a sucker member rotatable about a horizontal axis, wherein there is a suction inlet that opens to a sucker surface facing away from that axis. Folded file folders are stacked in a magazine with their surfaces substantially upright and their folds lowermost and parallel to said axis. A front folder in the magazine has its front surface tangent to a rear portion of the orbit of the sucker surface, where that surface moves upward, to be attached to the sucker member by suction and thus lifted, opened and moved forward into nip rollers near the top of that orbit. At each revolution of the sucker member the magazine is advanced forward through a distance equal to the thickness of a folded folder.

8 Claims, 6 Drawing Figures

FILE FOLDER UNFOLDING MACHINE

FIELD OF THE INVENTION

This invention relates to a machine for unfolding folded file folders and is more particularly concerned with a machine whereby a stack of folded file folders can be automatically opened one-by-one in rapid succession and discharged unfolded to a delivery location—which can be either a pile board or a conveyor—so that specialized accessories such as index tabs, labels, fasteners or the like can be readily attached to the opened folders.

BACKGROUND OF THE INVENTION

File folders, such as the common folders of manila paper that are used in large quantities in most offices, are normally manufactured, packaged and stored in folded condition. It is often necessary for a supplier of such folders to attach special accessories to each of a batch of them, to meet the requirements of a particular customer or customers. The accessories may take the form of any of a variety of tabs, labels, fasteners or the like, and often the accessories can be installed by means of a machine that operates automatically or semi-automatically and at a fast rate.

However, before accessories can be installed, the file folders must be unfolded; and heretofore no satisfactory device has been available for automatically unfolding file folders. As a result, unfolding has had to be performed by hand, in a slow and very tedious operation that substantially slowed the production of accessorized file folders and increased their cost. A proficient worker can manually open 12,000 to 14,000 file folders during an eight-hour working day, but fasteners can be installed on about 70,000 folders during the same period, so that at least four persons must be employed in opening folders to keep up with fastener installation.

The majority of file folders are sold without accessories. Therefore, it would not be economical to produce unfolded folders especially for installation of accessories, because production of unfolded folders would require costly modifications of folder manufacturing equipment and would create problems with respect to storage, inventory and folding after accessories are applied.

So far as is known, only one attempt has been made to produce a machine for opening file folders automatically, and it has not been successful. From the fact that file folders continue to be opened manually in many shops, it is evident that the provision of a machine for performing this operation automatically has heretofore been beyond the reach of skill in the relevant art.

SUMMARY OF THE INVENTION

The general object of the present invention is to satisfy the long-felt need for a reliable and fast-operating machine that can eliminate the tedious and expensive manual opening of file folders.

More specifically, it is an object of this invention to provide a machine which can automatically unfold folded file folders one-by-one, in rapid succession, and which can deliver the opened folders either to a pile board upon which they are formed into a stack or to a conveyor which can carry them to another machine where accessories are applied to them.

A more specific object of the invention is to provide a file folder opening machine wherein folded folders are removed one-by-one from a stack and wherein the movement of each folder as it is carried away from the stack is such as to subject it to cooperating forces of gravity and air drag that cause it to be swung open.

Another specific object of the invention is to provide a folder opening machine having a magazine that is divided into a plurality of compartments, each of which can hold a predeterminated number of folded folders with each folder in a substantially upright position and having its fold lowermost, said machine having sucker means whereby folders are removed from each compartment and opened in rapid succession, and also having means whereby the magazine is automatically so advanced towards the sucker means that after removal of the last folder from one compartment the first folder is removed from the next compartment without delay or hesitation.

It is also an important object of this invention to provide a versatile machine of the character described, capable of opening file folders of a wide variety of styles, sizes and thicknesses, and requiring few and simple adjustments to adapt it for operation with different folders.

Another object of the invention is to provide a machine which achieves the several objects set forth above, which operates very reliably at a fast rate, and which is simple in construction, easily maintained, low in cost and economical to operate.

These and other objects of the invention that will appear as the description proceeds are achieved in the file folder opening machine of this invention, which, in the preferred embodiment described hereinafter, has been found to operate very satisfactorily at a rate of about 120 folders per minute, and which is therefore capable of doing the work of four persons opening folders manually with good average proficiency.

In general, the machine of this invention is characterized by rotary sucker means comprising a sucker member having a surface thereon to which an air inlet opens outwardly, means mounting the sucker member for rotation about a substantially horizontal axis with said surface facing away from that axis, and means for driving the sucker member for rotation about the axis in one direction to carry said air inlet in an orbit, in a rear portion of which the air inlet moves generally upward and in a directly subsequent upper portion of which it moves in a generally forward direction. There is a connection between the sucker member and a vacuum source whereby air is drawn into the air inlet. The machine also comprises magazine means for supporting a stack of file folders with their surfaces substantially upright, their folds lowermost and extending transversely to said forward direction, and an upper portion of a front surface of a front folder in the stack substantially tangent to said one portion of said orbit, so that said front folder can be attached by vacuum to the sucker member to be lifted and partially unfolded by the rotary sucker means as the air inlet moves through said rear portion of its orbit. The machine also comprises delivery means located adjacent to said upper portion of said orbit and arranged to engage a front edge portion of a folder drawn upwardly and forwardly by the rotary sucker means and to advance the folder edgewise in said forward direction to a position in which the folder is spaced from said orbit.

To enable each in turn of a stack of folders to be lifted and removed from the magazine by the rotary sucker means, the machine preferably has feed means for advancing said magazine in said forward direction, through a distance substantially equal to the thickness of a folded file folder, with each rotation of the sucker member about said axis.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

General Arrangement and Mode of Operation

Figure 1:
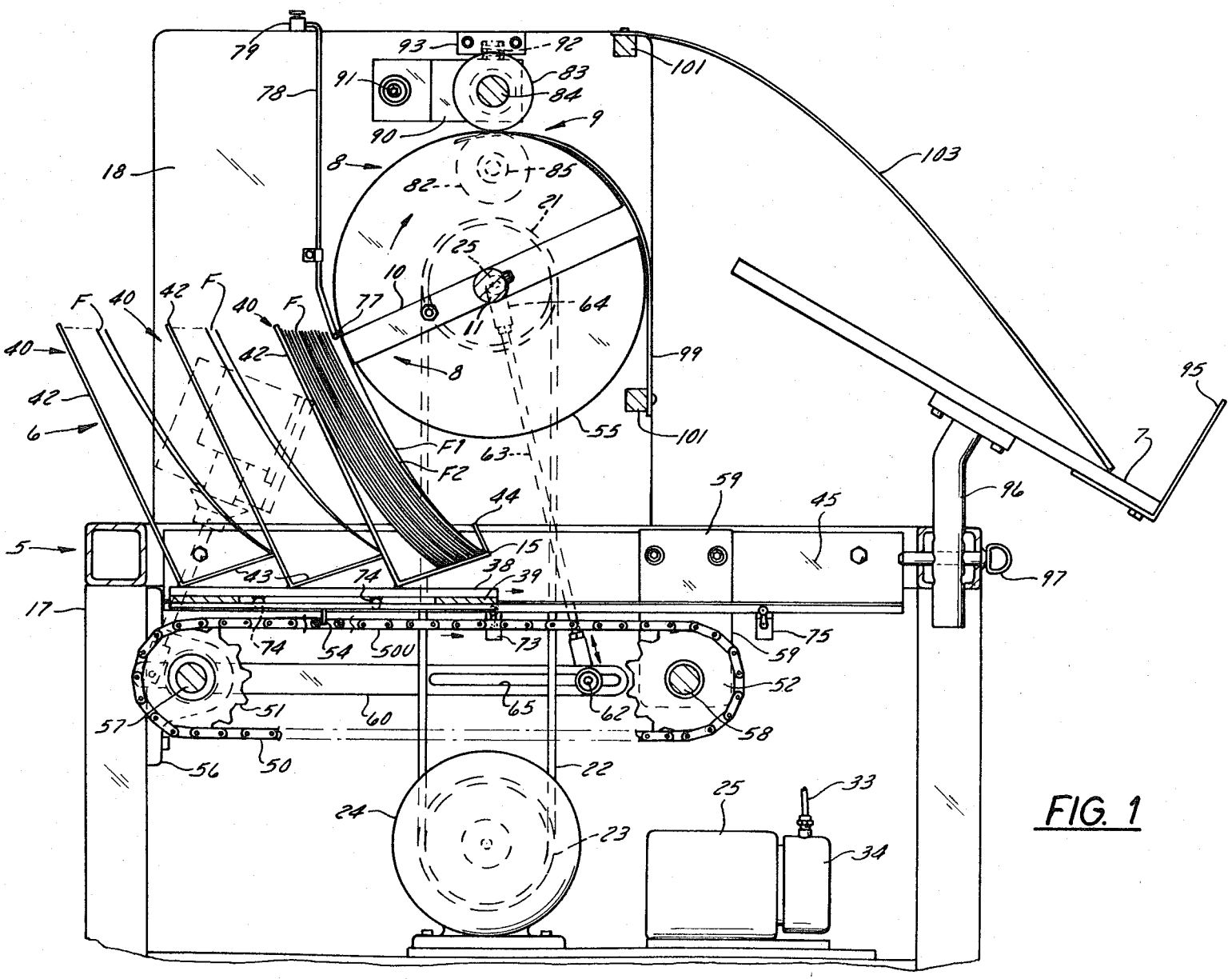
FIG. 1 is a view of the machine in longitudinally extending vertical section, showing it in a condition in which it is about to withdraw a file folder from the magazine.
Figure 2:
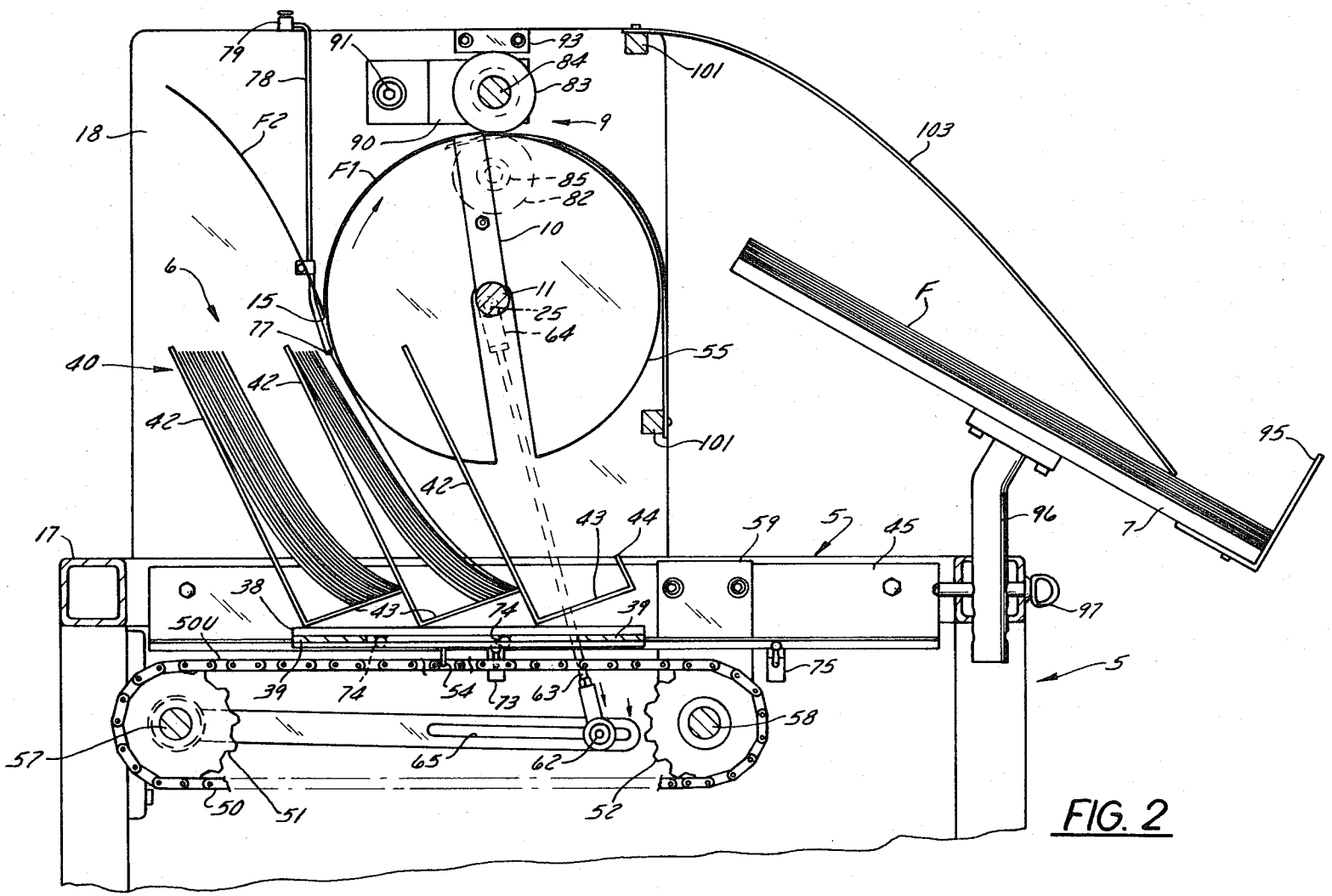
FIG. 2 is a view generally similar to FIG. 1 but illustrating a later stage of operation, and with a file folder withdrawn from the magazine and just presented to the nip of the delivery means.
Figure 3:
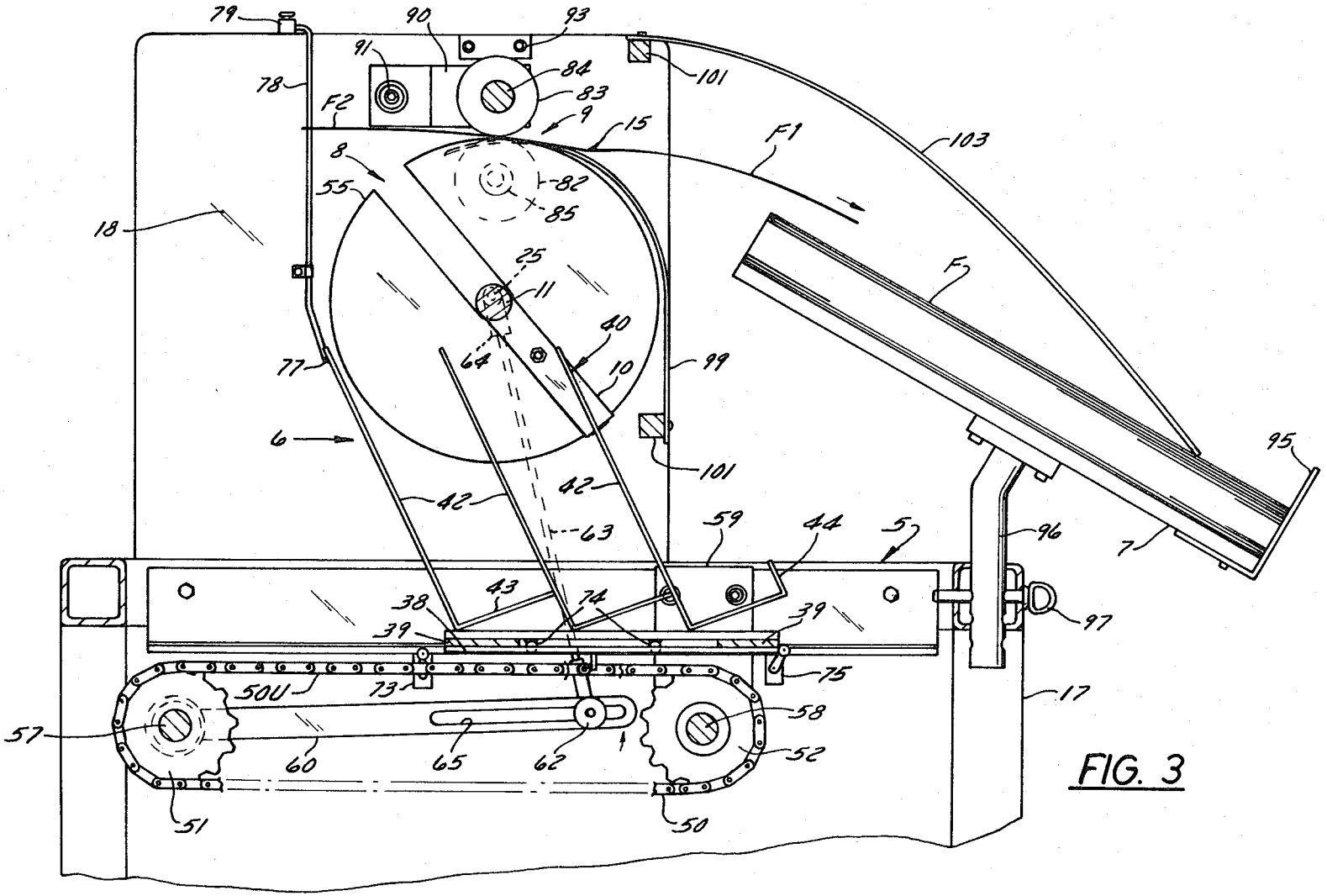
FIG. 3 is a view generally similar to FIGS. 1 and 2 but illustrating a still later stage of operation in which a last folder has been removed from the magazine and is being delivered to the pile board.
Figure 4:
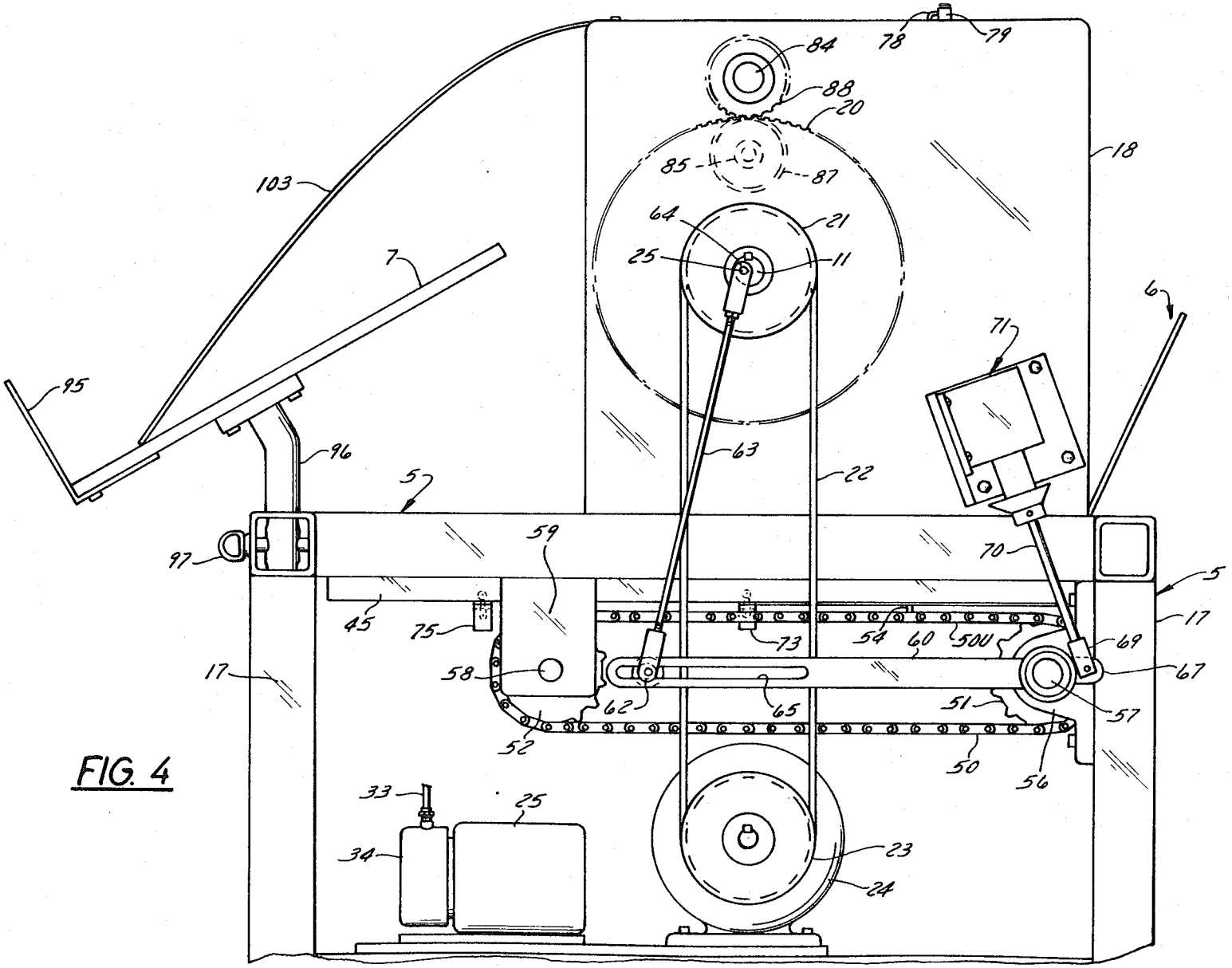
FIG. 4 is a view of the machine in elevation, as seen from its drive side.
Figure 5:
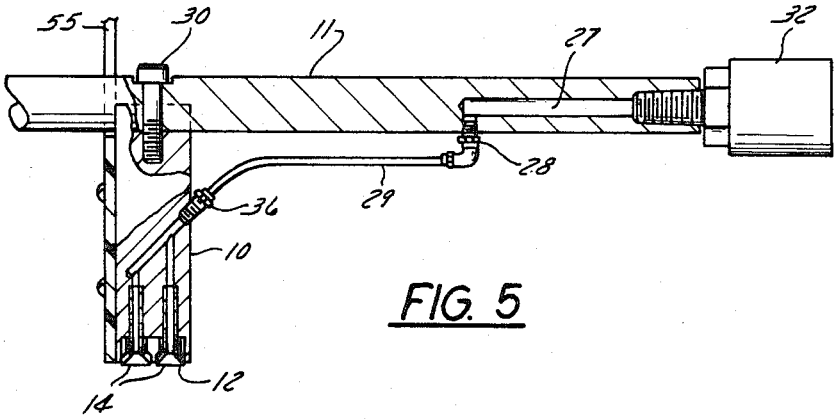
FIG. 5 is a detail view of the rotary sucker means, with portions cut away and shown in section.
Figure 6:
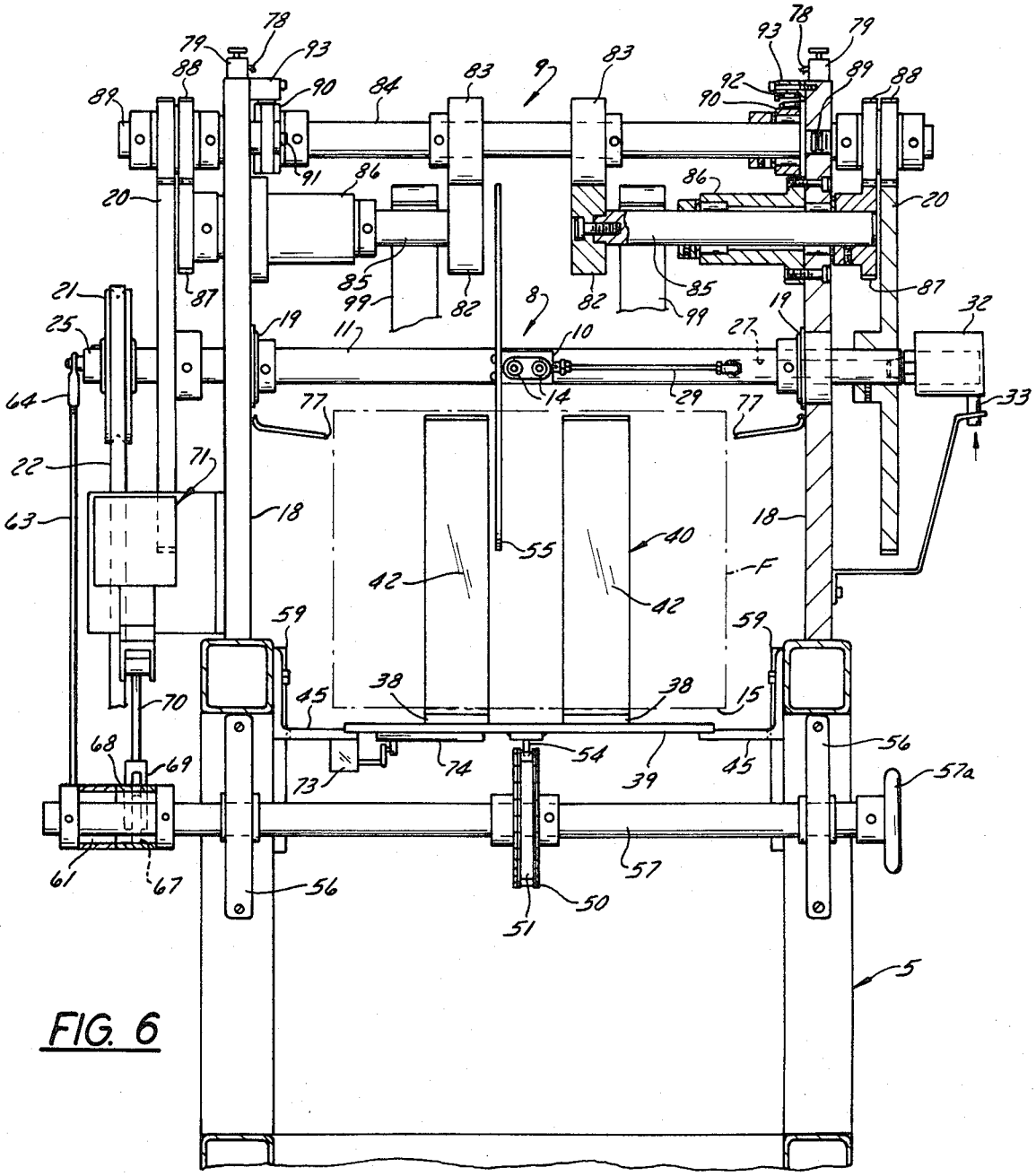
FIG. 6 is a view of the machine in transverse vertical section, looking forwardly from just behind the rotary sucker means.

The machine of this invention comprises a sturdy, somewhat elongated frame 5 that carries on its rear end portion a magazine 6 into which folded file folders F can be loaded in stacks, to be unfolded and delivered forwardly onto a pile board 7 at the front of the machine.

The folded folders F are removed one-by-one from the magazine 6 by rotary sucker means 8, whereby each folder is unfolded as it is drawn upwardly and forwardly away from the stack and whereby the unfolded folder is presented to delivery means 9 that carries the folder forwardly away from the rotary sucker means 8 and discharges it onto the pile board 7. It will be obvious from the following description that the pile board 7 could be replaced by a suitable conveyor (not shown) onto which the delivery means 9 could discharge unfolded folders for further forward travel.

The rotary sucker means 8 comprises an elongated, more or less block-like sucker member 10 that is secured at one end to a rotary shaft 11 which extends horizontally, transversely to the length of the machine frame 5. The sucker member 10 thus projects lengthwise radially from its shaft 11, and its outer end is formed as a substantially flat sucker surface 12 that faces away from the axis of the shaft 11. There is at least one air inlet 14 in the sucker member 10, opening to its end surface 12, and in this case two such air inlets are shown, having their axes contained in a plane that also contains the axis of the shaft 11. As explained hereinafter, the air inlets 14 are connected with a vacuum source. Preferably the air inlets 14 are defined by conical elastic suction cups, as is conventional in suction grippers.

The sucker means shaft 11 is driven for rotation in one direction, as more particularly explained hereinafter, whereby the sucker member surface 12 and the air inlets 14 that open to it are carried in a fixed orbit. The direction of sucker means rotation is such that the sucker surface 12 is carried generally upwardly when it is in a rear portion of its orbit, proximal to the magazine 6, and moves generally forwardly through the upper portion of its orbit.

Every folder F in the magazine has its fold 15 lowermost and extending horizontally, transversely to the plane of the orbit of the sucker surface 12; and the front folder in the magazine is so located and oriented that its front surface is tangent to the rear portion of that orbit. Therefore, as the sucker surface 12 moves through the rear portion of its orbit and comes into flatwise engagement with the front folder F in the magazine, the front leaf F1 of that folder is attached to the sucker member by suction. Thereafter the arcuate upward and forward motion of the sucker surface 12 and its air inlets 14 lifts the folder and draws its front leaf F1 away from the rear one F2, which swings back and down under the combined forces of gravity and air drag. As the sucker surface 12 moves through the upper portion of its orbit with a file folder attached to it by suction, it brings the leading edge of that file folder into engagement with the delivery means 9, which in the present case comprises nip rolls as described hereinafter. The delivery means 9 continues the edgewise forward advance of the file folder at substantially the same speed that the sucker member 10 had been moving it.

As continuing rotation of the sucker means carries the air inlets 14 downwardly away from the folder that is engaged by the delivery means, the vacuum seal of the sucker member 10 to the folder is broken, so that the sucker member detaches itself from the unfolded folder, which continues to be advanced under sole control of the delivery means 9, whereby it is discharged onto the pile board 7.

After the front folder has been lifted clear of the magazine, and before the sucker surface 12 returns to the rear portion of its orbit, the magazine 6 is moved forward, as explained hereinafter, to bring the new front file folder in the magazine to the right location for pickup by the sucker member 10 during the next upward movement of its sucker surface 12.

Rotary Sucker Means

The frame 5 of the machine comprises a base portion 17, preferably made up of square-section tubular material, and a pair of opposite and parallel wall-like members 18, each projecting up from one side of the base portion, which cooperate to support the rotary shaft 11 for the sucker member 10 as well as certain other rotary shafts described hereinafter. Thus, the sucker means shaft 11 extends axially through bearings 19 that are fixed in the upright frame members 18.

The block-like sucker member 10 is secured to the shaft 11 midway between the upright frame members 18. For such securement the sucker member 10 has a concavely arcuate radially inner end surface that closely fits the shaft, and a bolt 30 extends through a transverse bore in the shaft and is threaded into the sucker member.

The end portions of the sucker means shaft 11 project outwardly beyond the respective upright frame members 18, and on each end portion of the shaft there is secured a large diameter gear 20, preferably having an effective radius equal to the radius of the orbit of the sucker member end surface 12. These gears 20 provide for a driving connection between the sucker means 8 and the delivery means 9, as explained hereinafter. On a drive end portion of the shaft 11, axially outwardly of the gear 20, there is secured a sheave 21 by means of which the shaft 11 is driven for rotation, through a belt 22 which is trained around that sheave 21 and around a driving sheave 23 on the shaft of a motor 24 mounted on the bottom portion of the frame. Axially outwardly of the sheave 21 an eccentric 25 is fixed to the shaft 11, for driving the magazine 6 in its advancing movements as explained hereinafter.

The opposite end portion of the shaft 11, which can be considered its vacuum connection end, has a coaxial blind bore 27 therein that extends inwardly beyond the adjacent upright frame member 18 and terminates at a lateral bore that opens radially outwardly to one side of the shaft, between said upright member 18 and the sucker member 10. A nipple 28 is threaded into said lateral bore for connection with one end of a flexible vacuum tube 29 that has its other end connected to the sucker member 10. Connected to the vacuum end portion of the shaft 11 is a rotary union 32 which communicates with the outer end of the coaxial blind bore 27 therein and which is in turn connected by means of a vacuum duct 33 with a vacuum source, here shown as a pump 34 that is mounted on the base portion 17 of the frame. It will be understood that the vacuum pump 34 can be driven by the motor 24 or by a separate motor 25, or the vacuum duct 33 can be connected with a vacuum source that is remote from the machine.

The air inlets 14 in the block-like sucker member 10 are defined by blind bores which are communicated at their inner ends with a lateral bore in the sucker member, opening to the side of it that is proximal to the nipple 28; and a nipple 36 in this lateral bore in the sucker member provides for connection of the air inlets 14 with the vacuum tube 29 and thus with the vacuum source.

Magazine

The magazine 6 comprises a pair of elongated coplanar base members 38 that extend in the fore-and-aft direction of the machine and are spaced to opposite sides of its longitudinal centerline. The base members 38 are connected at their undersides by transversely extending members 39. Mounted on the top of each base member 38, secured to it as by means of weldments, are a plurality of L-shaped compartment-defining members 40. In this case there are three of the L-shaped members 40 on each fore-and-aft extending base member 38, and each leg of each L-shaped member is coplanar with the corresponding leg of a cooperating laterally adjacent L-shaped member 40 on the other base member 38.

Each L-shaped member 40 has a longer leg 42 which is generally upright but which is inclined upwardly and rearwardly at an angle of about 65° to the horizontal, and it has a shorter forwardly projecting leg 43 that is disposed at a slightly obtuse angle (e.g., 96°) to its longer leg. The shorter leg 43 of each of the two rear L-shaped members on each base member 38 has its front edge engaged against the longer leg 42 of the L-shaped member ahead of it, which thus defines a front abutment; and the front L-shaped member has, in each case, a short, upwardly projecting abutment 44 on the front edge of its shorter leg.

It will be evident that the longer legs 42 of the L-shaped members 40, in cooperation with the abutment 44, define three compartments for the magazine, each capable of holding a stack of folded file folders. Preferably the compartments are so dimensioned that each can receive fifty folders. Each folder has its fold lowermost and extending horizontally, resting on the coplanar shorter legs 43 of a pair of laterally opposite L-shaped members. The rearmost file folder of each stack has its rear leaf resting flatwise against the longer leg 42 that defines the rear of its compartment. Because of the slump or curvature that the folders assume under their own weight, there is a tendency for their bottoms to slide forward, but such sliding is limited by the limited forward extension of each shorter leg 43 and by the abutment at the front of it, thus ensuring that every folder in the magazine will be in an attitude such that it can be tangent to the orbit of the sucker surface 12, as is necessary for reliable sucker pickup. Also, the shorter leg 43 of each L-shaped member is at a slightly obtuse angle to its longer leg 42 such that all file folders resting on the shorter leg will have their top edges in a horizontal plane, so that every folder will be attached to the sucker member 10 at the same distance below its top edge.

Preferably the machine frame is made wide enough for legal size file folders to be receivable in the magazine, and in that case any smaller size folders can of course be equally well accommodated. Because of the manner in which the machine operates, the width of a batch of folders, measured transversely to their folds, is not critical.

The magazine 6 as a whole is confined between fixed side rails 45 on the frame, which guide it for sliding forward and rearward motion. At each rotation of the rotary sucker means 8 the magazine is advanced forward through a distance equal to the thickness of a folded file folder, so that the front file folder in the magazine, whatever its location in the magazine, will always be tangent to the rear portion of the orbit of the sucker surface 12 and thus in a position to be picked up by the sucker means. The mechanism for imparting such incremental forward motion to the magazine 6 comprises a drive chain 50 that is trained around a rear drive sprocket 51 and a front idler sprocket 52 to have an upper stretch 50U that extends forwardly beneath the magazine, along its longitudinal centerline. As explained hereinafter, the drive sprocket 51 is driven in small increments of rotation from the eccentric 25 on the driving end of the sucker means shaft 11.

The driving connection between the magazine and the upper chain stretch 50U comprises a pin 54 that is fixed to the underside of the magazine and projects down from it by a distance to have its lower end just above the pitch center of the upper chain stretch 50U. By reason of this connection, the magazine is drawn forward with the upper chain stretch 50U, but it can be readily manually disengaged from the chain, preferably by lifting it very slightly, but even by merely dragging it across the chain links of the upper stretch. The magazine can thus be drawn rearwardly relative to the chain for reloading or for clearing a jam or the like, and it can likewise be moved forwardly to a starting position at which its front folder will be picked up immediately by the sucker means. To assist an operator in shifting the freshly loaded magazine directly to the starting position, the orbit of the sucker surface 12 is in effect depicted by a transparent plastic disc 55 which is concentrically mounted on the sucker shaft 11, axially adjacent to the sucker member 10, and which has a radius equal to that of the sucker surface 12. The disc 55 also prevents the front leaf of a front file folder in the magazine from falling open, confining that leaf to the proper attitude for pickup by the sucker member.

It will be apparent that the L-shaped members 40 that define the magazine compartments are arranged in pairs, spaced to opposite sides of the longitudinal centerline of the magazine, so that the sucker member 10, in moving orbitally, can pass between the two L-shaped members of each pair for pickup of folders in compartments behind the front one.

Returning to the means for driving the chain 50 for incremental forward movements of its upper stretch 50U, the rear driving sprocket 51 for that chain is secured to a horizontally extending freely rotatable shaft 57 which is journaled in brackets 56 that project forward from rear legs of the frame. The idler sprocket 52 is mounted on a similar freely rotatable shaft 58, carried by downwardly projecting brackets 59 fixed to opposite sides of the frame. A swingable actuating arm 60, extending generally fore-and-aft along the drive side of the machine frame, has its rear end connected with the drive sprocket shaft 57 through an overrunning clutch 61 and has at its front end an adjustable connection 62 with the lower end of a link rod 63. The upper end portion of the link rod 63 is formed as a socket 64 in which is received the eccentric 25 that rotates with the sucker means shaft 11.

It will be apparent that rotation of the sucker means shaft 11 and its eccentric 25 imparts to the link rod 63 a generally lengthwise up and down movement, and the link rod, in turn, causes the front end of the actuating arm 60 to swing up and down about the axis of the shaft 57. In the upward swing of the actuating arm 60, the overrunning clutch 61 allows it to rotate freely around the shaft 57; during its downward swing the arm 60 is coupled to the shaft 57 by the overrunning clutch, and it rotates that shaft through an angle equal to that of its downward swing. This small rotation of the shaft 57 is of course imposed upon the drive sprocket 51 and advances the upper stretch 50U of the chain through a small distance.

The connection 62 between the link rod 63 and the actuating arm 60 is adjustable along the length of the actuating arm, to provide for varying the angle through which the arm 60 swings with each rotation of the eccentric 25. As the connection 62 is shifted rearward along the arm 60, its angle of swing increases, increasing the amount of forward magazine movement at each swing of the arm and thus accommodating thicker file folders. The connection 62 can comprise a lengthwise extending slot 65 in the front end portion of the arm 60, and preferably there are indicia at intervals along that slot which designate positions of adjustment for file folders of different specified thicknesses.

As the last file folder in a stack is drawn out of a compartment, the magazine 6 should be advanced a substantial distance forwardly to bring the front folder in the next compartment into tangency to the sucker orbit. To provide for such greater compartment-to-compartment advance, there is a second actuating arm 67, substantially shorter than the actuating arm 60 but similarly having one end connected with the shaft 57 through an overrunning clutch 68. At its other end the shorter actuating arm 67 is connected by means of a clevis 69 and a link rod 70 with the plunger of a solenoid 71 that is mounted on the machine frame. Energization of the solenoid 71 swings the arm 67 in the direction to move the magazine forward through the relatively large angle needed to advance it from compartment to compartment. In this case the solenoid 71 is so located that the arm 67 is biased in the opposite direction by gravity.

The solenoid 71 is energized under the control of a microswitch 73 that is fixed on the machine frame and is actuated by trip bars 74 mounted on the bottom of the magazine. A second microswitch 75 on the machine frame is positioned to be actuated by one of the trip bars and is so connected with the motor 24 as to stop rotation of the rotary sucker means 8—and thus also stop advance of the magazine—when the magazine is in its most forward position. Such automatic stopping of the machine signifies the need for drawing the magazine rearwardly and reloading it with file folders.

A handwheel **57*a* is coaxially mounted on the shaft 57** for advancing the magazine to exactly a starting position.

Folders which have been stored for some time are compressed so that their front and back leaves tend to stick together by suction. To inject air between the leaves of the front folders in the magazine, and thus facilitate their opening as they are drawn up out of the magazine, downwardly blowing air jet outlets 77 are mounted on the machine frame, one near each side of it, a little behind the rearmost portion of the orbit of the sucker surface 12 and just above the level of the upper edges of folders in the magazine. In the pressure air line 78 that leads to each air outlet nozzle 77 there is preferably a throttling valve 79 by which ejection of air from the nozzle can be manually adjusted in accordance with the condition of folders being loaded into the machine.

Delivery Means

The delivery means 9 comprises a pair of coaxial but axially spaced apart lower nip rollers 82 that are driven from the gears 20 on the sucker means shaft 11, and a cooperating pair of upper idler nip rollers 83, similarly spaced apart, coaxially mounted on a common nip roller shaft 84 that is biased downwardly so that each of the upper nip rollers 83 tends to be maintained in rolling engagement with its associated lower nip roller 82. The two coaxial nip rollers of each pair are spaced to opposite sides of the orbit of the block-like sucker member 10, and the axes of the two pairs of nip rollers 82, 83 are contained in a vertical plane that also contains the axis of rotation of the sucker means 8. Further, the nip of the roller pairs 82, 83 is at the same distance from the sucker means axis as the sucker surface 12, so that the leading edge of a file folder carried by the sucker means will be delivered directly into the nip of the rollers 82, 83.

Because of this relationship of the nip rollers and the sucker means orbit, the sucker member 10, as it moves through the upper portion of its orbit, must pass between the two lower nip rollers 82, and therefore those rollers 82, although coaxial, are mounted on separate shafts 85 that have their inner ends spaced apart by a distance to provide clearance for the sucker member 10. Each of the coaxial shafts 85 has a cantilevered mounting in a single axially elongated bearing 86 that is fixed in one of the upright frame members 18. To the projecting outer end portion of each shaft 85 there is fixed a driven gear 87 that is driven from its adjacent large diameter gear 20 on the sucker means shaft 11 through an idler gear 88. Each idler gear 88, which meshes with both its large diameter gear 20 and its driven gear 87, is freely rotatable on a stub shaft 89 that is fixed to an upright frame member 18 and projects outwardly there-from. The pitch diameters of the driven gears 87 and the large diameter gears 20 are so related that the peripheral speed of the driven nip rollers 82 is equal to the orbital speed of the sucker surface 12, to ensure that folders will not be marred or marked by relative sliding of the nip rollers during the brief interval when each folder is engaged by both the sucker member 10 and the delivery means. The driven lower nip rollers 82 are preferably of metal, whereas the idling upper nip rollers 83 have their peripheral surfaces formed of hard urethane or the like.

The shaft 84 on which the upper nip rollers 83 rotate is carried by front end portions of a pair of arms 90 that are inwardly adjacent to respective upright frame members 18 and are pivoted at their rear ends on stub shafts 91 that are secured in those frame members. The front ends of the arms 90 can thus swing up and down to carry the upper nip rollers 83 from and towards rolling engagement with their respective lower nip rollers 82. For downward bias of the front end of each arm 90, a compression spring 92 reacts between it and a spring seat bracket 93 that is fixed to its adjacent upright frame member 18, over the front end of the arm.

The pile board 7 is mounted at a distance forward of the nip rollers 82, 83 and in forwardly spaced relation to the orbit of the sucker surface 12. So that unfolded folders will slide down onto it and form a pile after they pass out of the nip of the rollers 82, 83, the pile board 7 is inclined at an angle of about 30° to the horizontal, with its rear edge uppermost. Its position and inclination are such that the plane of its upper surface, if extended forwardly, would cut the upper nip rollers 83. Upwardly projecting abutments 95 at its front provide a stop for the front edges of file folders delivered to it, to terminate their forward motion and form them into a neat pile.

As here shown, the pile board 7 is preferably mounted on an upright post 96 which is receivable in a socket on the frame and secured by a transverse pin 97 that extends through coaxial holes in the socket and any one of a series of holes along the length of the post 96, so that the pile board is readily adjustable up and down and is removable for replacement by a conveyor.

To cooperate with the nip rollers 82, 83 in guiding unfolded folders onto the pile board, and to hold the folders away from the orbit of the suction surface 12 so that they cannot be reengaged by the sucker means, elongated outfeed guides 99 are fixed to the machine, each extending downwardly and forwardly in an arc substantially concentric to the sucker surface orbit but of somewhat larger radius than that orbit, and each having an upper end fixed just in front of the nip of the rollers 82, 83 and a lower end below the level of said orbit. The opposite ends of these outfeed guides are fixed to transverse bars 101 which bridge across the side frame members 18. In addition, a forwardly extending guide finger 103 can be arranged to engage the upper surfaces of folders moving onto the pile board 7. It can have an upper end pivoted to another transverse member 104 that bridges the frame members 18, above and in front of the nip rollers 82, 83, and can extend forwardly and downwardly to have its front end rest on folders stacked on the pile board.

From the foregoing description taken with the accompanying drawings it will be apparent that this invention provides a very fast, simple, reliable and inexpensive machine for automatically opening folded file folders, capable of operating with folders of a wide variety of sizes, thicknesses and styles and needing few and easily made adjustments for adapting it to different folders.

What is claimed as the invention is:

1. In a machine for opening folded file folders having a frame:

A. a rotary sucker member
  (1) mounted on said frame for rotation about a substantially horizontal axis,
  (2) having a sucker surface which faces away from said axis, and
  (3) having an air inlet that opens to said sucker surface;

B. means for driving said sucker member in rotation about said axis in one direction, to carry said sucker surface in an orbit that has a rear portion in which the sucker surface moves upward and an upper portion in which the sucker surface moves in a forward direction;

C. means providing a connection between said sucker member and a vacuum source whereby air is drawn into said air inlet;

D. magazine means on said frame for supporting a stack of folded file folders with
  (1) their surfaces substantially upright,
  (2) their folds lowermost and substantially parallel to said axis, and
  (3) a front surface of a front folder in the stack substantially tangent to said rear portion of said orbit so that said front folder can be attached by suction to the sucker member to be lifted and opened as the sucker surface moves through said rear and upper portions of its orbit, said magazine means having feed means to advance the file folders in a stack in said forward direction when a file folder is lifter from the front of the stack; and E. delivery means located adjacent to said upper portion of said orbit and arranged to engage an opened folder drawn upward and forward by the sucker member and to advance that folder edgewise forward to a position in which that folder is spaced from said orbit.

2. The machine of claim 1 wherein said magazine is guided by said frame for movement in said forward direction and in an opposite rearward direction, further characterized by:

F. said feed means being mounted on said frame for advancing said magazine forward through a distance equal to the thickness of a folded file folder with each rotation of the sucker member about said axis.

3. The machine of claim 2, further characterized in that said feed means comprises:

(1) an endless drive member;
(2) a pair of rotary elements about which said drive member is trained, said rotary elements being rotatable on said frame on axes that are parallel to the first mentioned axis and being located to provide said drive member with a fore-and-aft extending stretch adjacent to the magazine;
(3) means providing a releasable driving connection between the magazine and said stretch of the endless drive member;
(4) an eccentric constrained to rotate in unison with the rotary sucker member; and
(5) means providing an intermittent driving connection between said eccentric and one of said rotary elements whereby the latter is rotated in a direction to drive said stretch forwardly during a portion of each revolution of the eccentric.

4. The machine of claim 3, further characterized in that said means providing an intermittent driving connection comprises:

(1) an elongated driving arm having one end adjacent to the axis of said one rotary element and which projects substantially radially from that axis;

(2) an overrunning clutch connected between said one end of the driving arm and said one rotary element whereby the latter is rotated by swinging of the other end of the driving arm in only one direction about its axis; and (3) an oscillatory connection between said eccentric and said other end of the driving arm whereby the latter is swung in both directions about the axis of said one rotary element during each rotation of said eccentric.

5. The machine of claim 4, further characterized by said oscillatory connection comprising:

(1) an elongated link extending substantially transversely to said driving arm and having at one of its ends a connection with the eccentric whereby the link is reciprocated substantially lengthwise by rotation of the eccentric; and (2) means at the other end of said link providing a connection between it and said driving arm that is adjustably positionable at each of a plurality of locations along the length of the driving arm, for adjusting the distance through which the magazine is moved at each revolution of eccentric.

6. The machine of claim 1, further characterized by said delivery means comprising:

(1) a pair of lower nip rollers on said frame (a) which rotate on a common stationary axis adjacent to the upper portion of said orbit and (b) which are axially spaced apart for passage of said sucker means between them in its rotation;

(2) means rotatably driving each of said lower nip rollers at a peripheral speed substantially equal to the orbital speed of said sucker surface; and (3) coaxial freely rotatably upper nip rollers carried on said frame for bodily up and down movement and biased downward into rolling engagement with said lower nip rollers.

7. The machine of claim 6, further characterized by: the axis of said sucker member, said common axis of the lower nip rollers and the axis of the upper nip rollers all being contained substantially in a single upright plane.

8. In a machine for unfolding folded file folders having a frame:

A. a sucker member confined to rotation on said frame about a substantially horizontal axis and having a sucker surface which faces away from said axis and having a suction inlet that is connectable with a vacuum source;

B. means for rotating said sucker member in one direction about said axis to carry said sucker surface in an orbit that has a rear portion in which the sucker surface moves upward and an upper portion in which the sucker surface moves forward; and C. magazine means for supporting a stack of folded file folders in substantially upright flatwise overlying relation to one another with their folds lowermost and substantially parallel to said axis and with a front surface of a front one of the folders tangent to said rear portion of said orbit to be attached to the sucker member by suction from said vacuum source and to be lifted and opened as the sucker surface moves through the rear and upper portions of its orbit, said magazine means having feed means to move the stack in said forward direction, through a distance substantially equal to the thickness of a folded file folder, each time a file folder is lifted from the stack;

D. and delivery means at said upper portion to engage an opened folder and to advance that folder edgewise forward to a position spaced from said orbit.

* * * * *